US006747402B2

(12) United States Patent
Hato et al.

(10) Patent No.: US 6,747,402 B2
(45) Date of Patent: Jun. 8, 2004

(54) EL ELEMENT LIGHTING UNIT EMPLOYING THE SAME EL ELEMENT

(75) Inventors: Minoru Hato, Osaka (JP); Yoshiharu Abe, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 113 days.

(21) Appl. No.: 10/114,530

(22) Filed: Apr. 1, 2002

(65) Prior Publication Data

US 2002/0163299 A1 Nov. 7, 2002

(30) Foreign Application Priority Data

Apr. 3, 2001 (JP) ..... 2001-104110

(51) Int. Cl.[7] ..... H01J 1/20

(52) U.S. Cl. ..... 313/305; 313/506; 313/509; 313/504; 313/511; 313/512; 200/5 A; 200/316; 200/317; 200/315; 200/314; 200/313; 200/312; 200/311; 200/310; 200/309; 200/308; 250/227.22; 250/229; 362/23; 362/84; 362/30; 341/22; 345/170

(58) Field of Search ..... 313/506, 509, 313/511, 512, 504, 305; 200/317, 5 A, 308–316; 362/23, 84, 30; 341/22; 345/170; 250/227.22, 229

(56) References Cited

U.S. PATENT DOCUMENTS 4,060,703 A * 11/1977 Everett, Jr. ..... 200/5 A
4,388,554 A 6/1983 Suntola et al.
4,532,395 A * 7/1985 Zukowski ..... 200/314
5,239,227 A 8/1993 Kikinis
5,818,174 A * 10/1998 Ohara et al. ..... 315/169.3
5,899,553 A * 5/1999 Howell ..... 362/84
5,950,808 A * 9/1999 Tanabe et al. ..... 200/314
5,965,980 A 10/1999 Hagiwara et al.
6,091,194 A 7/2000 Swirbel et al.
6,157,127 A 12/2000 Hosokawa et al.
6,246,169 B1 * 6/2001 Pruvot ..... 313/506
6,271,631 B1 * 8/2001 Burrows ..... 315/169.3
6,278,417 B1 * 8/2001 Bock et al. ..... 345/4
6,368,730 B1 * 4/2002 Kishimoto et al. ..... 428/690
6,396,208 B1 * 5/2002 Oda et al. ..... 313/504
6,429,585 B1 * 8/2002 Kitazume et al. ..... 313/505
6,541,911 B1 * 4/2003 Tanabe et al. ..... 313/509
6,590,508 B1 * 7/2003 Howell et al. ..... 341/22
6,595,653 B2 * 7/2003 Saito et al. ..... 362/84
6,609,805 B1 * 8/2003 Nelson ..... 362/30

FOREIGN PATENT DOCUMENTS

TW 364275 7/1999
WO WO 97/34447 9/1997

OTHER PUBLICATIONS

Taiwanese Official Action for corresponding Taiwanese Patent Application 91106596, dated Jun. 9, 2003.

* cited by examiner

*Primary Examiner*—Nimeshkumar D. Patel
*Assistant Examiner*—Holly Harper
(74) *Attorney, Agent, or Firm*—RatnerPrestia

(57) ABSTRACT

An EL element includes plural light transmitting front-electrodes forming plural lines by wiring and plural back-electrodes forming plural lines by further wiring. The front-electrodes are angled relative to the back-electrodes and a light-emitting layer is disposed between the front-electrodes and the back-electrodes. The EL element combined with a controller works as a lighting unit, which controls light emission at any place, so that a variety of lighting is realized by the lighting unit.

23 Claims, 6 Drawing Sheets

EL ELEMENT LIGHTING UNIT EMPLOYING THE SAME EL ELEMENT

FIELD OF THE INVENTION

The present invention relates to an electro-luminescent (EL) element and a lighting unit employing the same EL element.

BACKGROUND OF THE INVENTION

Electronic apparatuses, including cellular phones and personal computers, have been equipped with various and better functions. Thus, EL element and lighting units used in such electronic apparatuses have been subject to a variety of requirements.

A conventional EL element is described hereinafter with reference to FIG. 8 and FIG. 9. FIG. 8 shows a sectional view of a conventional EL element. FIG. 9 is a perspective view illustrating respective layers laminated. The EL element comprises the following elements:

(a) transparent insulating base 1;

(b) transparent electrode layer 2 formed by printing an indium tin oxide (ITO) film or transparent synthetic resin film on the entire lower face of base 1;

where the ITO film is formed by a sputtering method or a electron beam evaporation method, and the optically transparent film is formed by printing transparent synthetic resin in which indium tin oxide is dispersed, (c) light emitting layer 3 formed by dispersing zinc sulfide base material of light emission into synthetic resin;

(d) dielectric layer 4 formed by dispersing barium titanate into synthetic resin;

(e) back-electrode layer 5 made of silver or carbon-resin composite; and (f) insulating layer 6 made of epoxy resin or polyester resin.

The elements (c), (d) and (e) are printed beneath element (b) in this order sequentially, and then element (f) is disposed beneath element (e) to cover all the elements.

The EL element structured above is disposed beneath a plurality of pushbuttons or a display device such as LCD, so that the EL element is used for illuminating an operating section or the display device of a lighting unit.

When a voltage is applied between transparent electrode layer 2 and back electrode layer 5, an entire surface of light emitting layer 3 disposed between layer 2 and layer 5 emits light. This light illuminates the pushbuttons or the display devices from their backs.

In the conventional EL element discussed above, the structure allows the entire EL element to emit light, so that the EL element can illuminate a plurality of pushbuttons or display devices simultaneously, i.e., overall lighting is achievable. However, this structure cannot illuminate only a specified pushbutton or a specified spot on the display device, i.e., partial lighting is not achievable. Therefore, a plurality of light-emitting elements such as EL elements or LEDs are desirably combined for achieving partial lighting. This structure, however, needs more components and increases the cost.

SUMMARY OF THE INVENTION

An EL element in accordance with an exemplary embodiment of the present invention comprises the following elements:

a light transmitting base;

a front electrode layer formed beneath the base;

a light-emitting layer formed beneath the front electrode layer; and a back electrode layer formed beneath the light-emitting layer.

The front electrode layer includes light transmitting front electrodes forming respective lines and front wiring-electrodes which couples the light transmitting front electrodes with each other. The back electrode layer includes back electrodes forming respective lines and back wiring-electrodes which couples the back electrodes with each other. The lines of the light transmitting front electrodes are overlaid above the lines of the back electrodes at a given angle via the light-emitting layer. The plural electrodes are coupled with each other by the wiring-electrodes to form a matrix, so that plural light-emitting pixels are formed. This structure allows a specified pixel to emit light or plural pixels to emit light simultaneously. As a result, a variety of lighting can be realized by this EL element.

DETAILED DESCRIPTION OF PREFERRED EMBODIMENT

Exemplary embodiments of the present invention are demonstrated hereinafter with reference to the accompanying drawings. Elements similar to those described in the background of the invention have the same reference marks.

First Exemplary Embodiment

Figure 1:
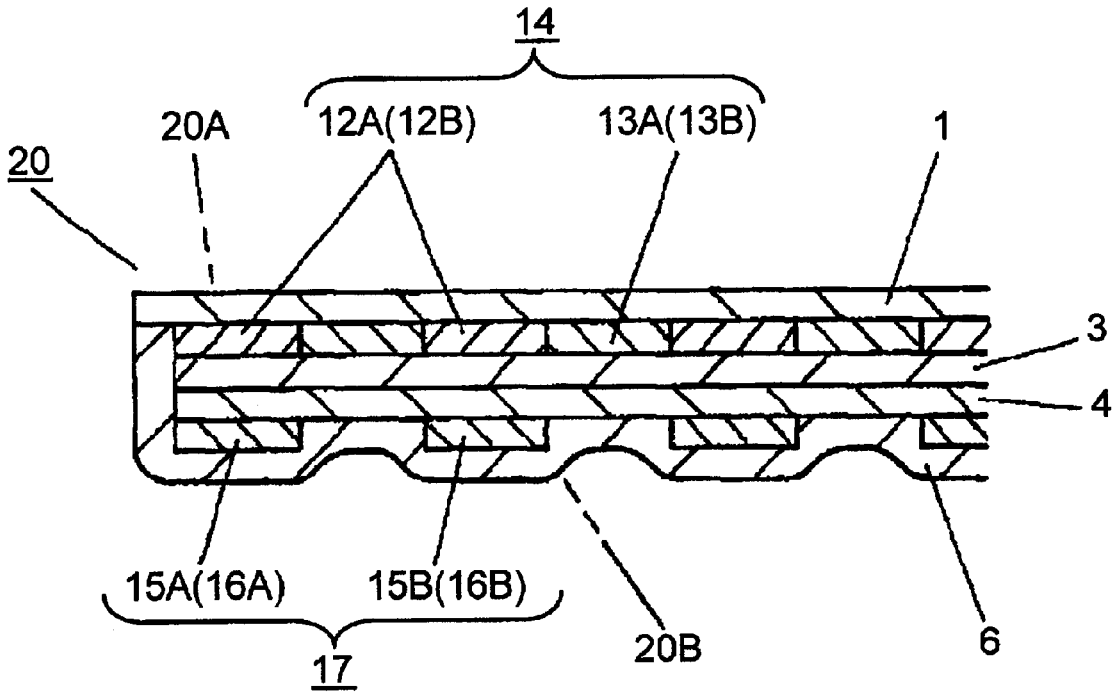
FIG. 1 is a partial sectional view of an EL element in accordance with a first exemplary embodiment of the present invention.
Figure 2:
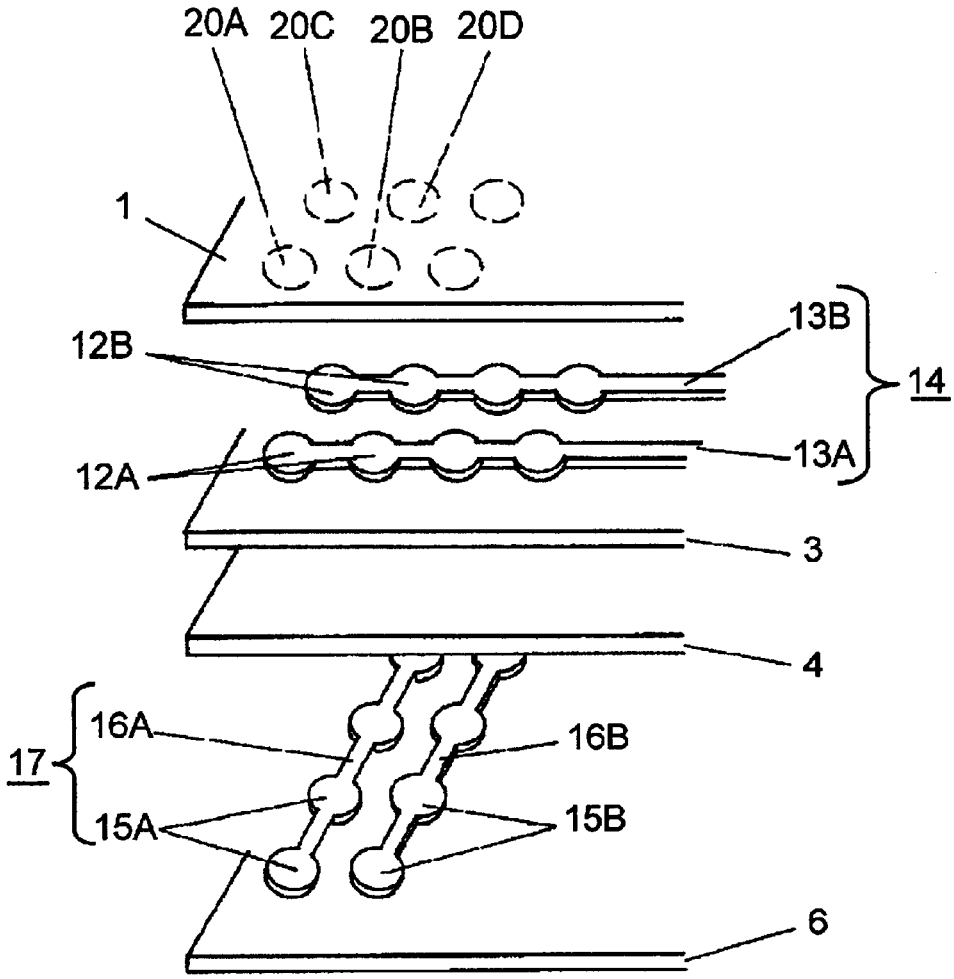
FIG. 2 is an exploded perspective view of the EL element in accordance with the first exemplary embodiment of the present invention.

FIG. 1 is a partial sectional view of an electro-luminescent (EL) element in accordance with the first embodiment. FIG. 2 is an exploded perspective view of the same EL element. The EL element of the present invention comprises the following elements:

light transmitting and insulating film base 1 made of polyethylene terephtalate or polyimide; and a plurality of light transmitting front electrodes 12A, 12B beneath base 1.

The light transmitting front electrode is formed by a printing method using light transmitting synthetic-resin in which ultra-fine powder of indium tin oxide (ITO) is dispersed. Besides the printing method, the light transmitting front electrode can be formed by a pattern formation using a sputtering method or an electron-beam evaporation method, where indium tin oxide is used as a target.

The plural front electrodes 12A, 12B are coupled by plural front wiring electrodes 13A, 13B respectively to form lines, whereby front electrode layer 14 is formed. Electrodes 13A, 13B are made of conductive material such as silver or carbon resin. Beneath layer 14, light-emitting layer 3 and dielectric layer 4 are printed in this order. Layer 3 is made of highly dielectric resin, such as polymeric material having cyano radical such as fluoro-rubber, cyano ethyl cellulose, cyano ethyl pullulan, in which zinc sulfide base material of light emission is dispersed. Layer 4 is made of highly dielectric resin in which barium titanate is dispersed. In this embodiment, light-emitting material employs inorganic EL material, however, polymeric organic EL material can be employed instead.

Beneath layer 4, plural back electrodes 15A, 15B made of conductive carbon resin or silver are formed facing front-electrodes 12A, 12B. The plural back-electrodes 15A, 15B are coupled by plural back wiring electrodes 16A, 16B oriented at right angles with respect to front wiring electrodes 13A, 13B respectively, and form lines, whereby back electrode layer 17 is formed.

Finally, those layers are covered with insulating layer 6 made of epoxy resin or polyester resin, so that EL element 20 is completed.

EL element 20 in accordance with the first embodiment is disposed beneath a plurality of pushbuttons or display devices including LCDs, and used for not only overall lighting, i.e., illuminating the plural places simultaneously but also partial lighting, i.e., illuminating a specified space only.

In other words, plural front electrodes 12A, 12B of front electrode layer 14 are coupled to each other by plural wiring-electrodes 13A, 13B to form lines, and plural back electrodes 15A, 15B of back electrode layer 17 are coupled to each other by plural wiring-electrodes 16A, 16B to form lines. The lines are crossed relative to each other at right angles to form a matrix. When a voltage is applied to each one line, e.g., electrodes 13A and 16A, among the wiring electrodes, only light-emitting layer 3 corresponding to pixel 20A emits light. Pixel 20A is sandwiched by a pair of pixel electrodes 12A and 15A, where wiring-electrodes 13A and 16A cross with each other. The light emitted from pixel 20A illuminates only a specified pushbutton or a specified spot on the display device.

When a voltage is applied simultaneously to each two lines among the wiring electrodes, namely, electrodes 13A, 13B and 16A, 16B, light-emitting layer 3 corresponding to pixels 20A, 20B, 20C, 20D emits light. Those pixels are formed by front electrodes 12A, 12B and back electrode 15A, 15B where each two lines cross with another each two lines.

When a voltage is applied to all the front wiring electrodes including electrodes 13A, 13B and all the back wiring electrodes including electrodes 16A, 16B, the entire light-emitting layer 3 emits light, and illuminates all the pushbuttons. As a result, the overall lighting is achieved.

In the drawings, the number of electrodes is limited to simplify the description. For instance, in FIG. 2, front wiring electrode only refers to two electrodes 13A and 13B; however, a number of front wiring electrodes, not shown in FIG. 2, are actually available.

The structure discussed above allows the EL element to perform a variety of lighting, and to be manufactured at an inexpensive cost because printing methods are mainly used to form each layer.

In this embodiment, plural wiring electrodes 13A, 13B and 16A, 16B of front electrode layer 14 and back electrode layer 17 respectively are formed independently of pixel electrodes 12A, 12B and 15A, 15B. However, wiring-electrodes 13A, 13B and light transmitting front electrodes 12A, 12B can be simultaneously printed, or wiring electrodes 16A, 16B and back electrodes 15A, 15B can be simultaneously printed, whereby a number of forming layers at manufacturing can be reduced for lowering a cost of the EL element. Those electrodes discussed above can be manufactured simultaneously by vacuum evaporation or spattering method.

Figure 3:
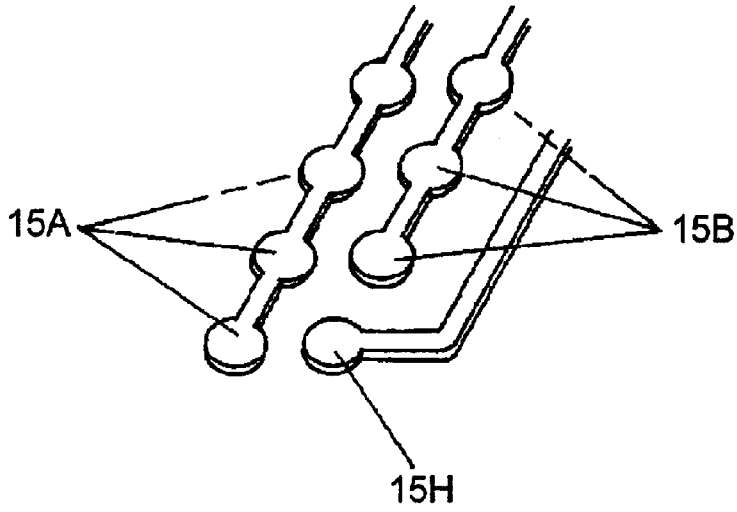
FIG. 3 is a perspective view of an essential part of the EL element shown in FIG. 2.

FIG. 3 shows a perspective view of an essential part of the EL element. Back electrode 15H independent of wiring electrodes 16A, 16B is illustrated as a part of back electrode layer 17. Only a place corresponding to electrode 15H can independently emit light, so that a greater variety of lighting can be realized. FIG. 3 illustrates a case where a part of the back electrode layer is independent; however, a part of the front electrode layer can be independent.

FIGS. 2 and 3 illustrate a case where the pixel electrodes are in the shape of a circle; however, the pixel electrode is not limited to a circle, but it can form a desirable shape such as a square, or a polygon. In FIG. 2, the wiring electrode connects pixel electrodes at their center; however, it connects them in a comb shape or a tree shape. In the first embodiment, the lines of the front electrode and the back electrode form right angles; however, the present invention is not limited to right angles, and any predetermined angle is applicable depending on an application.

Second Exemplary Embodiment

Figure 4:
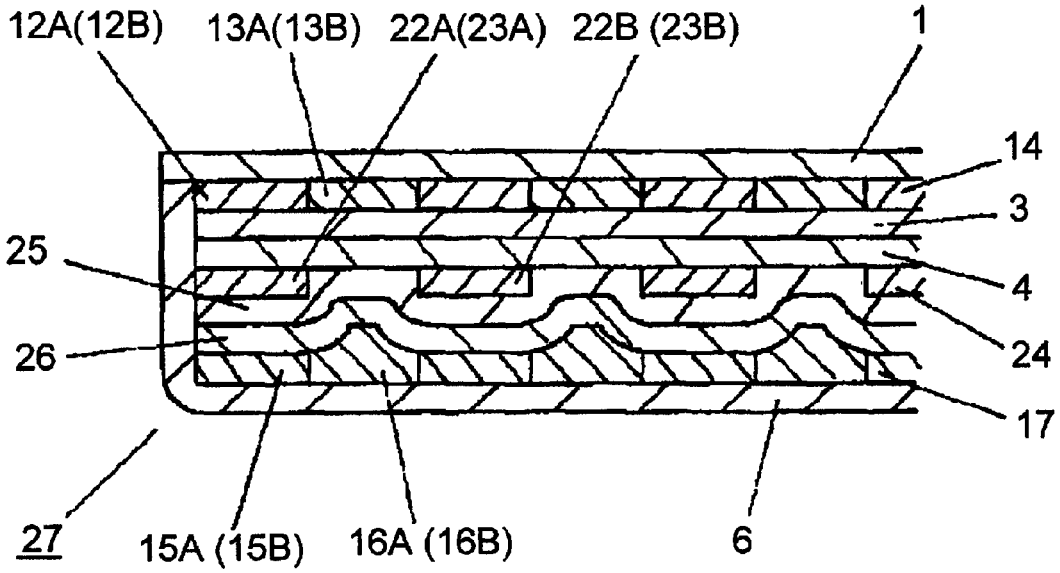
FIG. 4 is a partial sectional view of an EL element in accordance with a second exemplary embodiment of the present invention.

FIG. 4 is a partial sectional view of an EL element in accordance with the second exemplary embodiment of the present invention. Elements similar to those in the first embodiment have the same reference marks. The EL element has a similar structure to the first embodiment, i.e., the EL element comprises the following elements:

- light transmitting and insulating base 1;
- front electrode layer 14 disposed beneath base 1 and including a plurality of light transmitting front electrodes 12A, 12B which form respective lines and front wiring-electrodes 13A, 13B which couple electrodes 12A, 12B respectively;
- light-emitting layer 3 printed beneath layer 14; and
- dielectric layer 4 printed beneath layer 3.

In the second embodiment, middle electrode layer 24 is additionally formed beneath layer 3 by the same method as forming front electrode layer 14.

Middle electrode layer 24 comprises the following elements:

- plural light transmitting middle electrodes 22A, 22B forming respective lines; and
- plural middle wiring-electrodes 23A, 23B connecting electrodes 22A, 22B respectively and cross with front wiring-electrodes 13A, 13B respectively at right angles.

Then second light-emitting layer 25, which emits light in a color different from light-emitting layer 3, is printed beneath layer 24, and second dielectric layer 26 is further printed.

Back electrode layer 17 comprises the following elements:

- a plurality of back electrodes 15A, 15B forming lines respectively and facing middle light transmitting electrodes 22A, 22B; and
- back wiring-electrodes 16A, 16B coupling back electrodes 15A, 15B on the respective lines crossing with middle wiring electrodes 23A, 23B.

Finally, insulating layer 6 is formed to cover all the layers, so that EL element 27 is completed.

The EL element of the second embodiment comprises two light-emitting layers, i.e., the EL element has front electrode layer 14 on a first side of middle electrode layer 24 via light-emitting layer 3, and back electrode layer 17 on a second side of middle electrode layer 24 via second light-emitting layer 25.

When a voltage is applied between, e.g., one of front wiring electrodes 13A and one electrode of middle wiring electrodes 23A, the pixel at the intersection of the electrode 13A and the electrode 23A emits light. The light proper to light-emitting layer 3 illuminates only a specified pushbutton or a specified place on the display device.

When a voltage is applied between, e.g., one of middle wiring electrodes 23B and one of back electrodes 16B, only one pixel of light-emitting layer 25 emits light. The light proper to layer 25 which emits light having color different from that of layer 3 illuminates a specified pushbutton or a specified place on the display device.

If layer 3 is to emit light in blue-green and layer 25 is to emit light in red, a voltage applied between front wiring electrodes 13A and middle wiring electrodes 23A makes a pixel at the intersection of those electrodes emit light in blue-green. When a voltage is applied between middle wiring electrodes 23A and back electrodes 16A, a pixel at the intersection of those electrodes emits light in red.

When a voltage applied to a plurality of wiring electrodes of front electrode layer 14 and middle electrode layer 24, or a plurality of wiring electrodes of middle electrode layer 24 and back electrode layer 17 or every wiring electrode, a plurality of places of layer 3 and layer 25 or all the places of layer 3 and layer 25 emit light in a color proper to layer 3 or layer 25.

When a voltage is applied simultaneously to front electrode layer 14, middle electrode layer 24 and back electrode layer 17 of a specified pixel, light-emitting layers 3 and 25 emit light simultaneously, and mixed color of blue-green and red, i.e., white color, is obtained.

In other words, the EL element in accordance with the second embodiment comprises front electrode layer 14, middle electrode layer 24 and back electrode layer 17. Between those layers, light-emitting layers 3 and 25 are disposed. Layers 3 and 25 emit light in different colors. A plurality of light transmitting electrodes 22A, 22B forming lines respectively are coupled by wiring electrodes 23A, 23B in each line, where wiring electrodes 23A, 23B cross with the wiring electrodes of front electrode layer 14 and back electrode layer 17. A plurality of pixels, which emit light in different colors, are thus formed. As a result, the second embodiment allows the EL element to perform, a variety of lighting in a variety of colors.

In the above descriptions, light-emitting layers 3 and 25 are printed on the entire surface of the base; however, those layers can be disposed at places corresponding to each light transmitting electrode and each back electrode in a size slightly greater than each pixel electrode of respective electrode-layers. In this case, the same number of light-emitting layers as the electrodes are formed individually.

In the second embodiment, the lines of the front electrode and the back electrode form right angles; however, the present invention is not limited to the right angles, and any predetermined angle is applicable depending on an application.

Third Exemplary Embodiment

Figure 5:
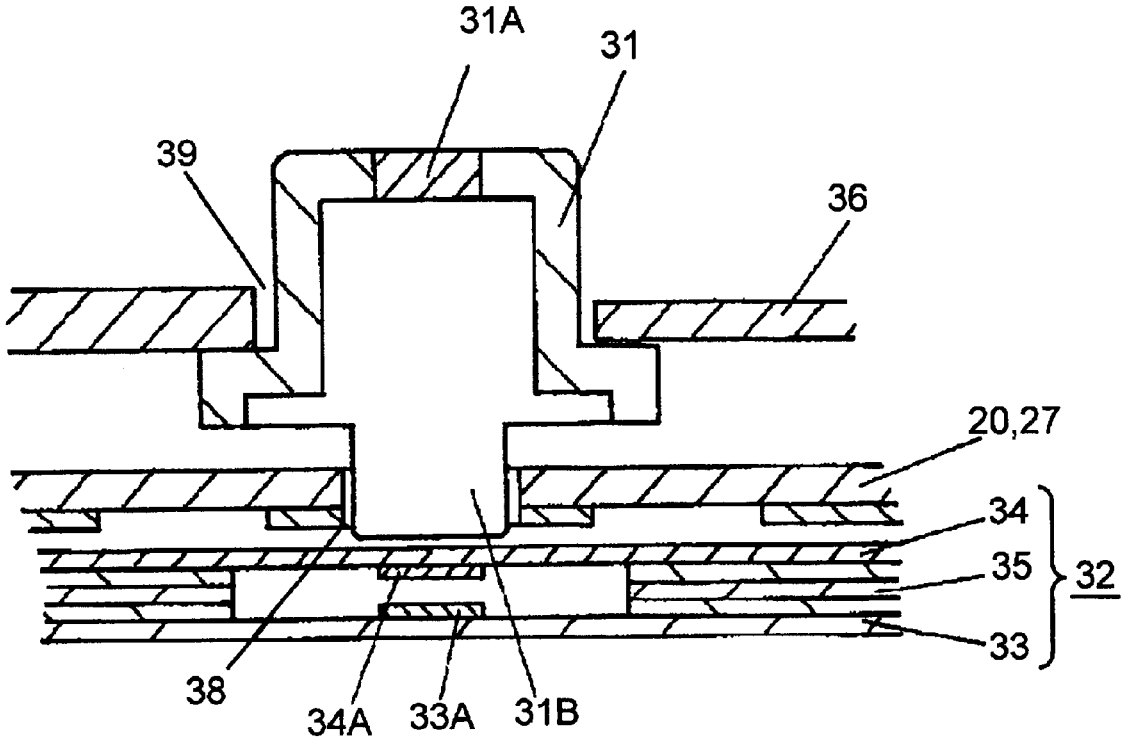
FIG. 5 is a partial sectional view of a lighting unit in accordance with a third exemplary embodiment of the present invention.
Figure 6A:
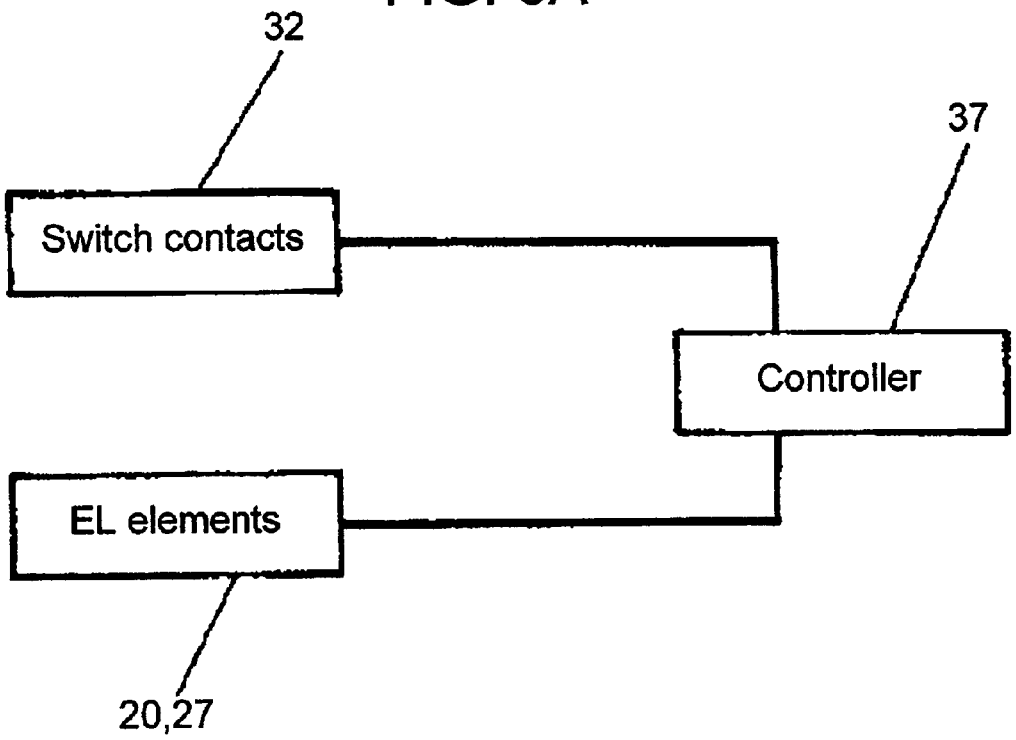
FIG. 6A is a block diagram of the lighting unit in accordance with the third exemplary embodiment of the present invention.

FIG. 5 is a partial sectional view of a lighting unit in accordance with the third exemplary embodiment of the present invention. FIG. 6A is a block diagram of the lighting unit. In FIG. 5, on an upper face of pushbutton 31, display section 31A in semi-transparence or milk-white is disposed, where letters, marks or designs are displayed. Pushbutton 31 is made of insulating resin such as dark ABS, polycarbonate or acrylic. Under pushbutton 31, a plurality of switch contacts 32 are disposed. Switch contact 32 formed by sticking flexible insulating film 34 to wired board 33 via insulating spacer 35 on which both faces adhesive is applied. Fixed contact 33A on wired board 33 faces movable contact 34A on a lower face of film 34 at a given space, so that a membrane switch is formed.

EL element 20 demonstrated in the first embodiment is placed on an upper face of switch contact 32. Through hole 38 is provided for extending depressing section 31B protruded from a lower face of pushbutton 31. An entire switch is covered by case 36 made of insulating resin, so that pushbutton 31 can protrude from opening 39 provided on an upper face of case 36.

FIG. 6A is a block diagram of the lighting unit in which controller 37 comprising a microprocessor, switching elements and an inverter is coupled to plural switch contacts 32 and EL element 20.

Figure 7:
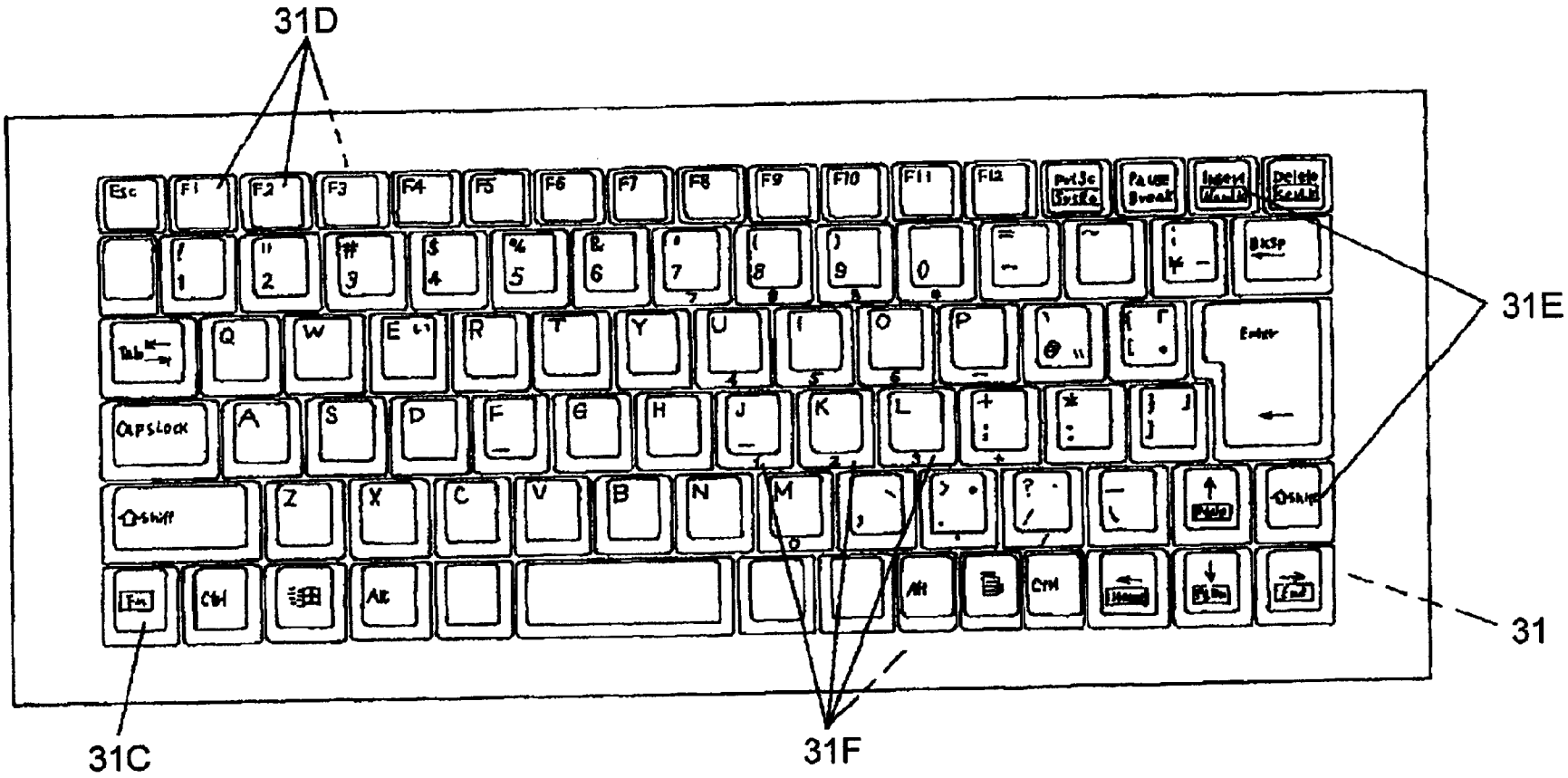
FIG. 7 illustrates an outward appearance of a keyboard in accordance with the third exemplary embodiment of the present invention.
Figure 8:
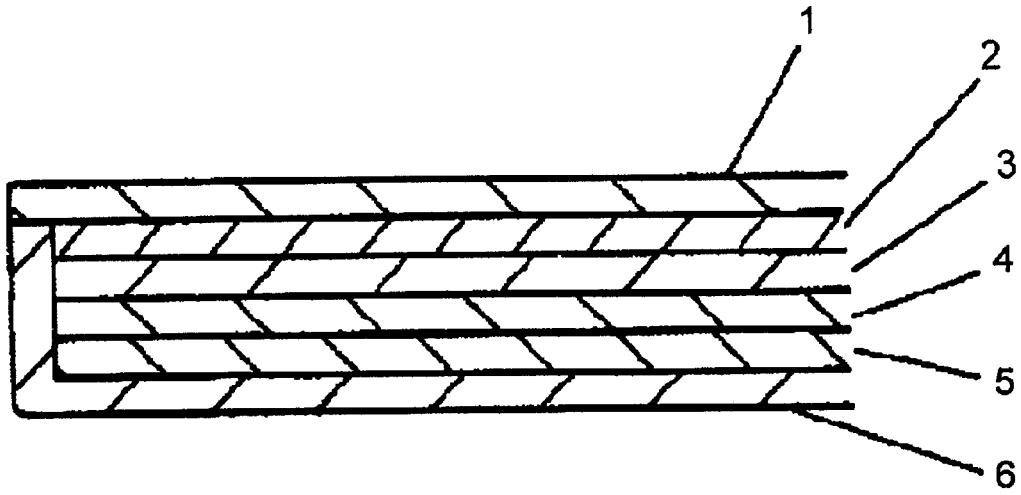
FIG. 8 is a partial sectional view of a conventional EL clement.
Figure 9:
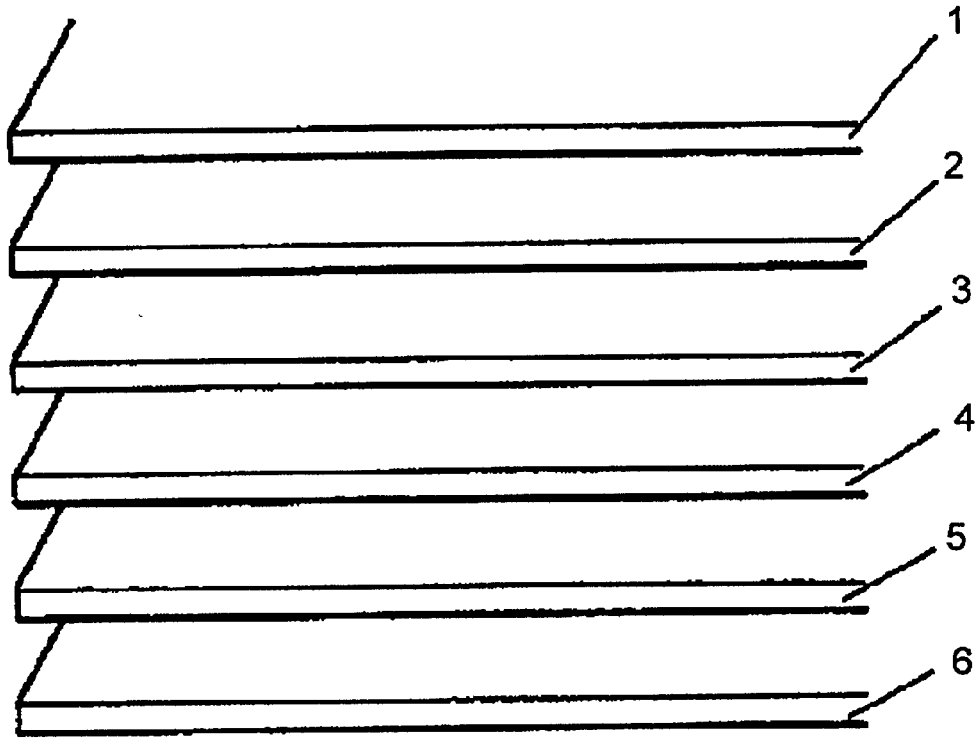
FIG. 9 is an exploded perspective view of the conventional EL element.

The lighting unit of the present invention is used, for instance, in a keyboard having plural pushbuttons 31 of a microcomputer system. An outward appearance of the keyboard is shown in FIG. 7.

When the keyboard is powered, controller 37 controls the light emission from EL element 20, so that individual pushbutton 31 can be illuminated or plural pushbuttons can be simultaneously illuminated.

For instance, when a voltage is applied between the entire front wiring electrodes and the entire back wiring electrodes, all the pixels emit light, so that all pushbuttons 31 arrayed on the keyboard are illuminated from the bottom. Thus even in dark environment, a user can recognize the letters, marks, or designs on pushbutton 31 and identify respective pushbuttons.

Controller 37 controls individual pixel of the EL element independently, which allows blinking individual pushbutton 31 sequentially, or controller 37 controls plural pixels of the EL element simultaneously, which allows blinking pushbuttons 31 in respective lines repeatedly. These controls were described in the first and the second embodiments.

Further, as shown in FIG. 6A, controller 37 is connected to plural switch contacts 32 to control the light emission from EL element 20 such that specified pixels of EL element 20 emit light responsive to pressing pushbuttons 31. As a result, the lighting following the functions of predetermined pushbuttons is obtainable.

Figure 6B:
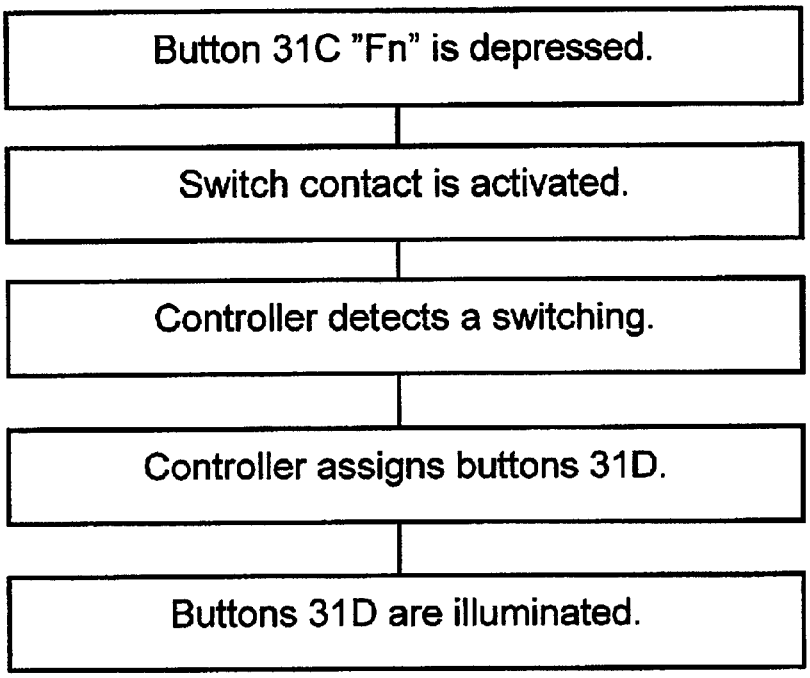
FIG. 6B is a flowchart illustrating how to control lighting.

In the case of pushbutton 31C in FIG. 7 assigned to button "Fn", the operation of the lighting unit is demonstrated here with reference to FIG. 6B. First, button 31C is depressed, which activates switch contact 32. Controller 37 detects a switching of contact 32, and assigns buttons 31D to "F1", "F2", "F3" and so on, corresponding to button "Fn". Controller 37 lights the pixels of the EL element corresponding only to buttons 31D. Those steps allow informing a user of the button to be pressed next by lighting the EL element.

EL element 27 of dual-layer construction instead of EL element 20 can realize lighting in multi-color. For instance, when the shift button and "NumLK" button 31E are depressed with all the pushbuttons 31 illuminated in blue-green, plural ten-keys 31F, corresponding only to the buttons depressed, can be controlled to be illuminated in red. This is an example of the multi-color lighting, which illuminates some buttons (ten-keys in this case) in different color from other buttons when key-operation is switched to the ten-keys. As a result, a user can input numbers with the ten-keys with ease.

The lighting unit in accordance with the third embodiment comprises the following elements:

a plurality of pushbuttons;

switch contacts 32 for performing electrical switching by depressing some of the pushbuttons;

EL element 20 or El element 27 disposed on an upper face or a lower face of the switch contacts; and controller 37 for electrically controlling plural switch contacts 32 or the EL element.

This structure allows controller 37 to control light emission from the EL element, so that a specified pushbutton is illuminated. Therefore, only a specified pushbutton can be illuminated using one EL element, or all the pushbuttons can be illuminated simultaneously. This lighting unit can thus realize a variety of lighting as discussed above.

The above descriptions refer to a membrane switch, i.e., fixed contact 33A on the upper face of wired board 33 faces movable contact 34A on the lower face of insulating film 34 at a given space. However, the present invention is not limited to the membrane switch. For instance, a switch device, in which a domed movable contact made of resilient metal foil is placed above a fixed contact on a wired board, allows a pushbutton to press the movable contact to bow downward, so that the movable contact and the fixed contactestablish an electrical connection. In another instance, a domed movable contact made of rubber or elastomer is brought into contact with a fixed contact. In still another instance, a switch device employing a single push-switch is used.

What is claimed is:

1. An electro-luminescent (EL) element comprising:

(a) a light transmitting base;

(b) a front electrode layer formed on said base, and including a plurality of light transmitting front electrodes each coupled together by respective front wiring electrodes to form a plurality of front lines, respectively;

(c) a back electrode layer including a plurality of back electrodes coupled together by back wiring electrodes to form a plurality of back lines;

(d) a light-emitting layer disposed between said front electrode layer and said back electrode layer, and (e) another light transmitting front electrode independent of the plurality of front lines, and another back electrode independent of the plurality of back lines;

wherein said plurality of front lines are placed above and angled relative to said plurality of back lines.

2. The EL element of claim 1, wherein the front wiring electrodes, said light-emitting layer, the plurality of back electrodes and the back wiring electrodes are formed by printing.

3. The EL element of claim 1, wherein said front electrodes are formed by printing.

4. The EL element of claim 1, wherein said front electrodes and the front wiring electrodes are formed by printing.

5. The EL element of claim 1, wherein said base is made of film-like light transmitting polymer material.

6. The EL element of claim 1, wherein said EL element is disposed on one of an upper face and a lower face of a plurality of switch contacts disposed under a pushbutton.

7. An electro-luminescent (EL) element according to claim 1, wherein said plurality of front electrodes are above respective corresponding locations of said plurality of back electrodes.

8. An electro-luminescent (EL) element comprising:

(a) a light transmitting base;

(b) a front electrode layer formed on said base, and including a plurality of light transmitting front electrodes each coupled together by respective front wiring electrodes to form a plurality of front lines, respectively;

(c) a middle electrode layer including a plurality of light transmitting middle electrodes coupled together by middle wiring electrodes to form a plurality of middle lines facing said front electrodes;

(d) a back electrode layer including a plurality of back electrodes coupled together by back wiring electrodes to form a plurality of back lines;

(e) a first light-emitting layer disposed between said front electrode layer and said middle electrode layer;

(f) a second light-emitting layer disposed between said middle electrode layer and said back electrode layer, and (g) another light transmitting front electrode independent of the front wiring electrodes, and another back electrode independent of the plurality of back lines;

wherein the plurality of front lines are placed above the plurality of back lines in parallel, and placed above and angled relative to the plurality of middle lines.

9. The EL element of claim 8, wherein the front wiring electrodes, said first light-emitting layer, the middle wiring electrodes, said second light-emitting layer, the back electrodes and the back wiring electrodes are formed by printing.

10. The EL element of claim 8, wherein the front electrodes and the middle electrodes are formed by printing.

11. The EL element of claim 8, wherein said base is made of film-like light transmitting polymer material.

12. An electro-luminescent (EL) element according to claim 8, wherein said plurality of middle electrodes are above respective corresponding locations of said plurality of back electrodes.

13. An electro-luminescent (EL) element according to claim 8, wherein said front electrodes are above respective corresponding locations of said plurality of middle electrodes.

14. An electro-luminescent (EL) element comprising:

(a) a light transmitting base;

(b) a front electrode layer formed on said base, and including a plurality of light transmitting front electrodes each coupled together by respective front wiring electrodes to form a plurality of front lines, respectively;

(c) a middle electrode layer including a plurality of light transmitting middle electrodes coupled together by middle wiring electrodes to form a plurality of middle lines facing said front electrodes;

(d) a back electrode layer including a plurality of back electrodes coupled together by back wiring electrodes to form a plurality of back lines;

(e) a first light-emitting layer disposed between said front electrode layer and said middle electrode layer;

(f) a second light-emitting layer disposed between said middle electrode layer and said back electrode layer, and wherein the plurality of front lines are placed above the plurality of back lines in parallel, and placed above and angled relative to the plurality of middle lines, wherein the EL element is disposed on one of an upper face and a lower face of a plurality of switch contacts disposed under a pushbutton.

15. A lighting unit comprising:

(a) a plurality of pushbuttons;

(b) a plurality of switch contacts disposed under said pushbuttons for performing electrical switching;

(c) an electro-luminescent (EL) element disposed on one of an upper face and a lower face of one of said switch contacts; said EL element including:

(d) a light transmitting base;

(e) a front electrode layer formed on said base, and including a plurality of light transmitting front electrodes each coupled together by respective front wiring electrodes to form a plurality of front lines, respectively;

(f) a back electrode layer including a plurality of back electrodes coupled together by back wiring electrodes to form a plurality of back lines; and (g) a light-emitting layer disposed between said front electrode layer and said back electrode layer, wherein said plurality of front lines are placed above and angled relative to said plurality of back lines, (h) a controller for being coupled to said switch contacts and said EL element, wherein said controller controls light emission from said EL element at a given place while preventing emission from said EL element away from said given place, so that a pushbutton corresponding to the given place is illuminated.

16. The lighting unit of claim 15, wherein the given pushbutton is disposed on a keyboard.

17. A lighting unit according to claim 15, wherein said plurality of front electrodes are above respective corresponding locations of said plurality of back electrodes.

18. A lighting unit comprising:

(a) a plurality of pushbuttons;

(b) a plurality of switch contacts disposed under said pushbuttons for performing electrical switching;

(c) an electro-luminescent (EL) element disposed on one of an upper face and a lower face of one of said switch contacts; said EL element including:

(d) a light transmitting base;

(e) a front electrode layer formed on said base, and including a plurality of light transmitting front electrodes each coupled together by respective front wiring electrodes to form a plurality of front lines, respectively;

(f) a back electrode layer including a plurality of back electrodes coupled together by back wiring electrodes to form a plurality of back lines; and (g) a light-emitting layer disposed between said front electrode layer and said back electrode layer, wherein said plurality of front lines are placed above and angled relative to said plurality of back lines, (h) a controller for being coupled to said switch contacts and said EL element, wherein said controller controls light emission from said EL element at a given place while preventing emission from said EL element away from said given place, so that a pushbutton corresponding to the given place is illuminated, and wherein said controller has a detecting function of detecting a press of a given pushbutton, and a controlling function of controlling light emission from an EL element designated by the given pushbutton at a given place, and said controller detects the press of the given pushbutton and illuminates a pushbutton assigned by the given pushbutton.

19. A lighting unit comprising:

(a) a plurality of pushbuttons;

(b) a plurality of switch contacts for performing electrical switching by depressing at least one of said pushbuttons;

(c) an electro-luminescent (EL) element disposed on one of an upper face and a lower face of one of said switch contacts: said EL element including:

(d) a light transmitting base;

(e) a front electrode layer formed on said base, and including a plurality of light transmitting front electrodes each coupled together by respective front wiring electrodes to form a plurality of front lines, respectively;

(f) a middle electrode layer including a plurality of light transmitting middle electrodes coupled together by middle wiring electrodes to form a plurality of middle lines;

(g) a back electrode layer including a plurality of back electrodes coupled together by back wiring electrodes to form a plurality of back lines;

(h) a first light-emitting layer disposed between said front electrode layer and said middle electrode layer;

(i) a second light-emitting layer disposed between said middle electrode layer and said back electrode layer, wherein the plurality of front lines are placed above the plurality of back lines in parallel, and placed above and angled relative to the plurality of middle lines (j) a controller for being coupled to said switch contacts and said EL element, wherein said controller controls light emission from said EL element at a given place, so that a pushbutton corresponding to the given place is Illuminated.

20. The lighting unit of claim 19, wherein said controller has a detecting function of detecting a press of a given pushbutton, and a controlling function of controlling light emission from an EL element designated by the given pushbutton at a given place, and said controller detects the press of the given pushbutton and illuminates a pushbutton assigned by the given pushbutton.

21. The lighting unit of claim 19, wherein the given pushbutton is disposed on a keyboard.

22. A lighting unit according to claim 19, wherein said plurality of middle electrodes are above respective corresponding locations of said plurality of back electrodes.

23. An electro-luminescent (EL) element according to claim 19, wherein said front electrodes are above respective corresponding locations of said plurality of middle electrodes.

* * * * *